United States Patent [19]

Kitagawa et al.

[11] Patent Number: 4,929,394

[45] Date of Patent: May 29, 1990

[54] PROCESS FOR COMPACTING RADIOACTIVE METAL WASTES

[75] Inventors: Kazuo Kitagawa; Fumiaki Komatsu, both of Kobe; Takayoshi Masaki, Akashi; Yoshihisa Sawada, Nishinomiya; Eiichi Inada, Ibaraki; Masao Shiatsuki, Ibasaki, all of Japan

[73] Assignees: Kabushiki Kaisha Kobe Seiko Sho, Kobe; Doryokuro Kakunenryo Kaihatsu Jigyodan, Tokyo, both of Japan

[21] Appl. No.: 304,218

[22] Filed: Jan. 31, 1989

[30] Foreign Application Priority Data

Feb. 1, 1988 [JP] Japan ..... 63-22208

[51] Int. Cl.[5] ..... G21F 9/12; G21F 9/24; G21F 9/16

[52] U.S. Cl. ..... 252/633; 250/506.1; 252/628; 264/0.5; 419/48; 419/49; 419/68

[58] Field of Search ..... 264/0.5; 252/633; 419/42, 49, 51, 48, 68

[56] References Cited

U.S. PATENT DOCUMENTS

| | | | |
|---|---|---|---|
| 4,172,807 | 10/1979 | Larker | 252/633 |
| 4,409,029 | 10/1983 | Larker et al. | 419/10 |
| 4,642,204 | 2/1987 | Burstrom et al. | 252/633 |
| 4,645,624 | 2/1987 | Ramm et al. | 252/628 |
| 4,806,279 | 2/1989 | Ramm | 252/633 |
| 4,808,337 | 2/1989 | Ramm et al. | 252/628 |
| 4,834,917 | 5/1989 | Ramm et al. | 252/633 |

FOREIGN PATENT DOCUMENTS

| | | |
|---|---|---|
| 0044381 | 4/1985 | European Pat. Off. . |
| 3047697 | 5/1982 | Fed. Rep. of Germany . |
| 3110192 | 10/1982 | Fed. Rep. of Germany . |
| 3129852 | 5/1985 | Fed. Rep. of Germany . |
| 3720731 | 1/1988 | Fed. Rep. of Germany . |

*Primary Examiner*—Howard J. Locker

*Attorney, Agent, or Firm*—Oblon, Spivak, McClelland, Maier & Neustadt

[57] ABSTRACT

A process for compacting radioactive waste by precompressing the waste in each of capsules while filling the waste into the capsule to thereby compress the waste to the desired bulk/true density ratio under a small total pressing load and diminish damage to the inner surface of the die used, each of the capsules having a cross sectional form corresponding to a divided segment of the cross section of an HIP treatment container, then placing the capsules into the HIP treatment container, subsequently filling the HIP treatment container with a metal powder as a filler, thereafter degassing and sealing the HIP treatment container and subjecting the container to an HIP treatment in its entirety. The process precludes scattering of the radioactive substance from the waste and release of waste fragments to assure improved safety.

13 Claims, 3 Drawing Sheets

PROCESS FOR COMPACTING RADIOACTIVE METAL WASTES

BACKGROUND OF THE INVENTION AND RELATED ART STATEMENT

The present invention relates to a compacting process suitable for storing with safety over a prolonged period of time radioactive metal wastes such as spent nuclear fuel cladding (hereinafter referred to as "hulls") which are sheared into short lengths for nuclear fuel reprocessing.

In compacting and stabilizing such radioactive metal waste for storage of the waste, attention has been directed in recent years to a hot isostatic pressing (hereinafter referred to as "HIP") treatment.

For example, Examined Japanese Patent Publication SHO No. 57-959 discloses a process comprising precompressing radioactive metal waste in a die to obtain a block, filling the block into an HIP treatment container, degassing or non-degassing and sealing the HIP treatment container, and subjecting the sealed HIP treatment container to HIP treatment in its entirety. This process includes the precompressing step in order to give an increased bulk density (before the HIP treatment) to the radioactive metal waste to be filled into the HIP treatment container. The increased bulk density serves to minimize the deformation of the HIP treatment container by the HIP treatment and avoid a break of the HIP treatment container that would occur if the HIP treatment container is deformed greatly. From this viewpoint, it is desired that the precompressed (press-formed) block have a bulk density of at least 60% of true density (waste metallic density).

With the process disclosed in the above publication, the compressed block to be filled into the HIP treatment container has an outside diameter slightly smaller than the inside diameter of the HIP treatment container and is approximately equal to the HIP treatment container in cross sectional area. Thus, the waste is precompressed with a die which is approximately equal to the HIP treatment container in cross sectional area.

A considerably great total pressing load is required when the desired bulk density/true density ratio is to be obtained with such a die which is generally equal to the HIP treatment container in cross sectional area. For example, for a die 300 mm in outside diameter to achieve a bulk/true density ratio of 65%, the total pressing load needed is as great as 1400 t. The precompressing step of the above process therefore requires the use of a heavy embossing machine which is great in total pressing load and which necessitates an increased space for installation and is unfavorable in respect of the cost.

Further with the above process, the compressed block is filled directly into the HIP treatment container without using another container or the like, with the result that the radioactive substance adhering to the waste is likely to scatter about or the waste will release small fragments during the filling procedure. The process has another problem in that since the waste is filled into the die directly for precompression, the waste comes into direct frictional contact with the die to cause marked damage to the inner surface of the die.

SUMMARY OF THE INVENTION

The main object of the present invention is to provide a process for compacting radioactive metal wastes free of the foregoing problems.

The present invention provides a process for compacting radioactive metal waste comprising the steps of precompressing the waste in each of capsules while filling the waste into the capsule to thereby fill the capsule with the waste in a compressed state, each of the capsules having a cross sectional form corresponding to a divided segment of the cross section of an HIP treatment container, thereafter placing the capsules into the HIP treatment container, filling the voids inside the capsules and the HIP treatment container with stainless steel powder or like metal powder serving as a filler, subsequently sealing the HIP treatment container and subjecting the HIP treatment container to an HIP treatment in its entirety.

In this way, the waste is precompressed as filled in each of the capsules which has a cross section corresponding to a divided segment of the cross section of the HIP treatment container, whereby the waste can be pressed to the desired bulk/true density ratio under a great pressure as subjected to a smaller total pressing load than in the prior art without the likelihood of causing damage to the die used for the precompression. Futhermore, the waste as accommodated in the capsules is placed into the HIP treatment container. This prevents scattering of the radioactive substance or release of small waste fragments to assure improved safety.

BRIEF DESCRIPTION OF THE DREWINGS

FIG. 2 (*b*) is a sectional view taken along the line B—B in FIG. 2 (*a*);

DESCRIPTION OF THE PREFERRED EMBODIMENTS

Figure 1:
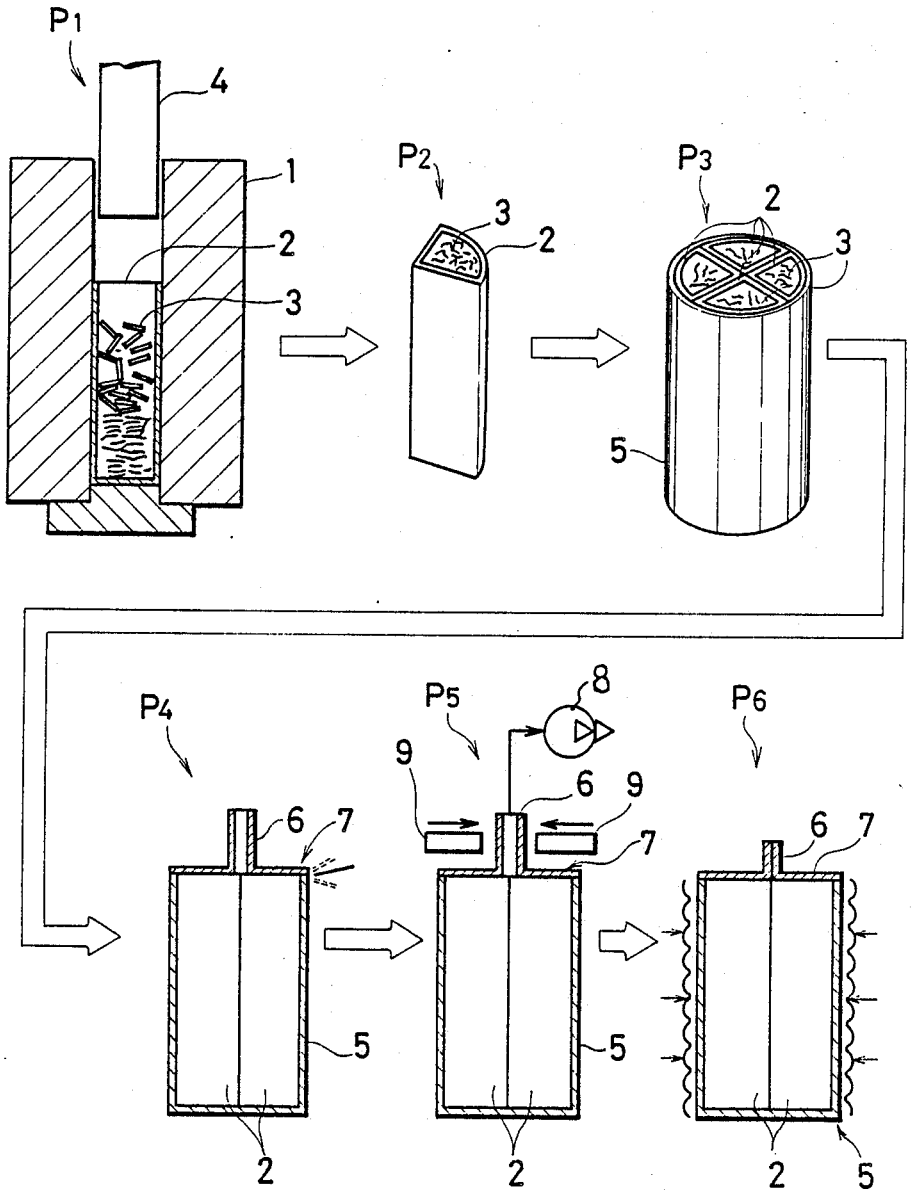
FIG. 1 is a diagram showing a process of compacting radioactive metal waste according to an embodiment of the present invention.
Figure 2:
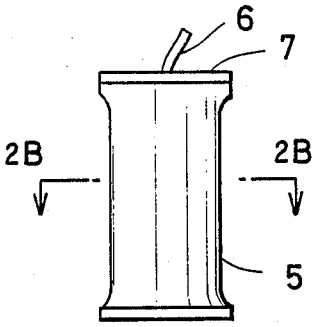
FIG. 2 (*a*) is a side elevation showing a compressed block formed by the process.
Figure 2:
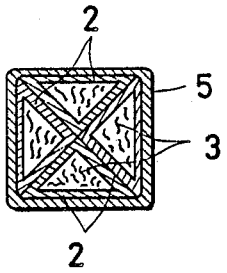

An embodiment of the present invention will be described with reference to FIGS. 1, 2 (*a*), 2 (*b*), and 7.

A die 1 is formed with a cavity having a sectorial cross sectional form corresponding to a quarter of a circle. A hollow capsule 2 approximately identical with the cavity in cross sectional form is inserted into the die 1 in step P1. The cross sectional form is identical with a quarter of the cross section of an HIP treatment container 5 to be described later. Hulls (radioactive metal waste) 3 are filled into the capsule 2 and pressed within the capsule 2 by a plunger 4, whereby the hulls 3 are precompressed. The plunger 4 is slightly smaller than the hollow space of the capsule 2 in cross sectional area so as not to collapse the upper end of the capsule 2.

Figure 7:
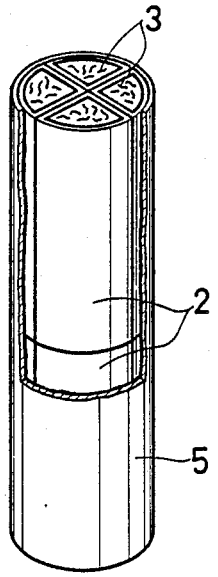
FIG. 7 is a perspective view of a HIP treatment container carrying capsules piled up in a multiplicity of layers, with a part broken away and in section.

By repeating the pressing operation and repeatedly replenishing the capsule 2 with hulls 3, the capsule 2 is filled with hulls 3 in a compressed state and then withdrawn in its entirety from the die 1 (step P2). Four capsules 2 thus filled with hulls 3 are filled without any clearance into the HIP treatment container 5 which is in the form of a hollow cylinder having an open upper end (step P3). The capsules 2 may be placed into the HIP treatment container 5 in a single layer with respect to the vertical direction as illustrated in FIG. 1. Such capsules 2 may be arranged in a multiplicity of layers with respect to the vertical direction as illustrated in FIG. 7.

When the HIP treatment container 5 is thus filled, a clearance or voids occur at the upper ends of the capsules 2 or inside the HIP treatment container 5. Accordingly, to fill such voids, stainless steel or like metal powder is filled into the HIP treatment container 5. This minimizes the deformation of the HIP treatment container 5 due to HIP treatment to preclude a break of the HIP treatment container 5 due to great deformation.

With the HIP treatment container 5 thus completely filled up, the opening of the HIP treatment container 5 is closed with a closure 7 having a degassing tube 6, and the closure 7 is welded along its periphery to the HIP treatment container 5 and thereby secured to the HIP treatment container (step P4). A slight clearance, if occurring between the closure 7 and the capsules 2, is preferably filled up with stainless steel powder or the like as described above.

Subsequently, a vacuum pump 8 is connected to the degassing tube 6 and operated to remove air from the inside of the HIP treatment container 5, and the degassing tube 6 is collapsed by a sealer 9 to seal off the HIP treatment container 5 (step P5). The sealed HIP treatment container 5 is then subjected in its entirety to HIP treatment at a high temperature and high pressure (step P6). Consequently, a compacted block of waste can be obtained which has a density approximately equal to the true density as illustrated in FIGS. 2 (*a*) and (*b*). Thus, the radioactive metal waste can be compacted and stabilized.

As an example, a multiplicity of small pieces of Zircaloy hulls, 10 mm in diameter, 30 mm in length and 0.8 mm in wall thickness, were compressed under a surface pressure of 2000 to 2500 kgf/cm$^2$ within a sectorial capsule measuring 70 mm in radius, 240 mm in height and 2.5 mm in wall thickness. Four such capsules were placed into an HIP treatment container 145 mm in diameter and 280 mm in height, and the HIP treatment container was then degassed with a closure welded thereto, sealed off and subjected to HIP treatment. The compressed block obtained was found to have a density almost equal to the true density.

With the present process, hulls 3 are precompressed within the capsule 2 which has $\frac{1}{4}$ the cross sectional area of the HIP treatment container 5, so that the pressure for compressing the radioactive metal waste to desired bulk/true density ratio can be obtained with a smaller total pressing load than in the prior art. This permits the use of smaller equipment including the die 1, etc. and serves to diminish the damage to the inner surface of the die 1. Moreover, hulls 3 can be transported as accommodated in the capsules 2 in the precompression step through the placement into the HIP treatment container 5. This precludes scattering of the radioactive substance from the hulls and release of waste fragments to assure improved safety.

Furthermore, hulls can be compressed in small amounts within the capsule 2 to provide a precompressed block of uniform density, with the result that the block accommodated in the HIP treatment container can be subjected to HIP treatment with reduced local deformation. According to the present embodiment, the HIP treatment container 5 in the form of a hollow cylinder is filled with capsules 2 without any clearance and thereby prevented from deformation during the HIP treatment to the greatest possible extent. The HIP treatment container 5 can then be easily checked for a smear test (checking method of contaminated state by the radioactive substance) by placing the HIP treatment container 5 on a rotary table or the like and holding a blade or the like in contact with the HIP treatment container in rotation. This achives an improved work efficiency.

Figure 3:
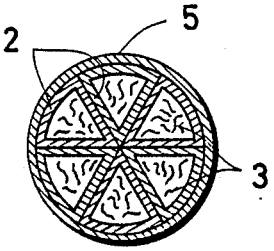
FIGS. 3 to 6 are sectional views showing HIP treatment containers and capsules according to other embodiments of the present invention.
Figure 4:
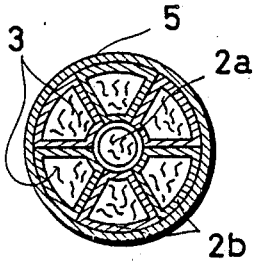

According to the present invention, the capsule 2 is not limited specifically in its cross sectional form. As seen in FIG. 3, the capsule may have a cross section identical with one of the six divided segments of the cross section of the HIP treatment container 5. Alternatively as seen in FIG. 4, capsules 2 may be so arranged that a cylindrical capsule 2*a* is positioned centrally of the HIP treatment container 5 and surrounded by a plurality of capsules 2*b*. These modifications achieve the same result as the above embodiment.

Figure 5:
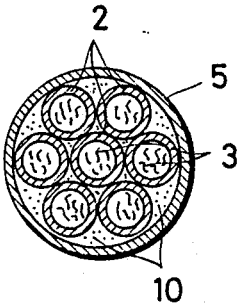

Further according to the present invention, the entire cross section of the HIP treatment container 5 need not be completely divided by the capsules. For example as seen in FIG. 5, a plurality of cylindrical capsules 2 may be filled in the cylindrical container 5 with some clearances left inside the HIP treatment container 5. In this case, however, the clearances are likely to permit the HIP treatment to locally deform the HIP treatment container 5 greatly to result in damage or break, so that it is desirable to fill up the clearance with stainless steel powder 10 or the like as shown in FIG. 5.

Figure 6:
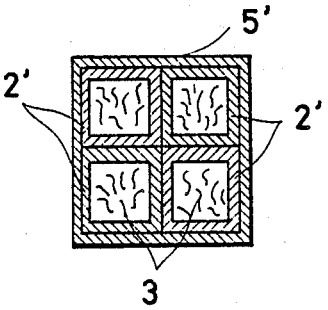

The HIP treatment container 5 is not limited to a circular cross section. The same result as already described can be achieved, for example, also by filling without clearance an HIP treatment container 5′ having a quadrilateral cross section with capsules 2′ each having a cross section identical with one of four equally divided segments of the quadrilateral as seen in FIG. 6.

What is claimed is:

1. A process for compacting radioactive metal waste comprising the steps of:

filling the waste into a plurality of capsules, each of said capsules being positioned in a die during said filling step;

precompressing only the waste in each of said capsules during said filling step, whereby said capsules are not compressed, wherein each of said capsules is filled with the waste in a compressed state and each of said capsules have a cross sectional form corresponding to a divided segment of the cross section of an HIP treatment container;

placing said capsules into an HIP treatment container;

filling the HIP treatment container with a metal powder serving as a filler; and sealing the HIP treatment container and subjecting said HIP treatment container to an HIP treatment in its entirety.

2. A process as defined in claim 1 wherein said step of filling the waste into said capsules comprises the steps of:

adding portions of said waste to each of said capsules;

precompressing said added portions; and repeatedly adding and precompressing said portions until said capsule is filled.

3. A process as defined in claim 1 wherein the metal powder is filled into voids within the HIP treatment container after the capsules are placed into the HIP treatment container.

4. A process as defined in claim 1 wherein the metal powder is stainless steel powder.

5. A process as defined in claim 1 wherein the HIP treatment container is in the form of a hollow cylinder.

6. A process as defined in claim 5 wherein four capsules each having a sectorial cross sectional form identical with one of four divided segments of a circle are placed into the HIP treatment container.

7. A process as defined in claim 5 wherein six capsules each having a sectorial cross sectional form identical with one of six divided segments of a circle are placed into the HIP treatment container.

8. A process as defined in claim 5 wherein the capsules each have a smaller circular cross section than the HIP treatment container and are placed into the HIP treatment container.

9. A process as defined in claim 5 wherein a hollow cylindrical capsule is positioned in the HIP treatment container centrally thereof and surrounded by a plurality of capsules.

10. A process as defined in claim 1 wherein the HIP treatment container is quadrilateral in cross section.

11. A process as defined in claim 10 wherein four capsules each having a quadrilateral cross sectional form identical with one of four divided segments of the quadrilateral are placed into the HIP treatment container.

12. A process as defined in claim 1 wherein the capsules are placed into the HIP treatment container in a single layer with respect to the vertical direction.

13. A process as defined in claim 1 wherein the capsules are piled up in the HIP treatment container in a multiplicity of layers with respect to the vertical direction.

* * * * *

UNITED STATES PATENT AND TRADEMARK OFFICE

CERTIFICATE OF CORRECTION

PATENT NO. : 4,929,394

DATED : May 29, 1990

INVENTOR(S) : Kazuo KITAGAWA, et al

It is certified that error appears in the above-identified patent and that said Letters Patent is hereby corrected as shown below:

On the Title page, the last inventor's name has been misspelled, it should read as follows:

--Masao SHIOTSUKI--

Signed and Sealed this

Fifteenth Day of October, 1991

*Attest:*

HARRY F. MANBECK, JR.

*Attesting Officer*

*Commissioner of Patents and Trademarks*